US011466226B2

(12) United States Patent
Walker et al.

(10) Patent No.: US 11,466,226 B2
(45) Date of Patent: Oct. 11, 2022

(54) ALKYLPHENOL DETERGENTS

(71) Applicant: The Lubrizol Corporation, Wickliffe, OH (US)

(72) Inventors: Gary M. Walker, Allestree (GB); James P. Roski, Mentor, OH (US); Ewan E. Delbridge, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/843,323

(22) Filed: Apr. 8, 2020

(65) Prior Publication Data

US 2020/0231891 A1 Jul. 23, 2020

Related U.S. Application Data

(63) Continuation of application No. 16/211,890, filed on Dec. 6, 2018, now abandoned, which is a continuation of application No. 15/313,128, filed as application No. PCT/US2015/031939 on May 21, 2015, now abandoned.

(60) Provisional application No. 62/003,608, filed on May 28, 2014.

(51) Int. Cl.

| | |
|---|---|
| ***C10M 133/44*** | (2006.01) |
| ***C10M 159/22*** | (2006.01) |
| ***C10M 129/10*** | (2006.01) |
| ***C10M 129/50*** | (2006.01) |
| ***C10M 135/10*** | (2006.01) |
| ***C10M 137/10*** | (2006.01) |
| ***C10N 10/02*** | (2006.01) |
| ***C10N 10/04*** | (2006.01) |
| ***C10N 30/02*** | (2006.01) |
| ***C10N 30/04*** | (2006.01) |
| ***C10N 30/06*** | (2006.01) |
| ***C10N 30/08*** | (2006.01) |
| ***C10N 30/10*** | (2006.01) |
| ***C10N 30/12*** | (2006.01) |
| ***C10N 30/00*** | (2006.01) |
| ***C10N 40/25*** | (2006.01) |

(52) U.S. Cl.

CPC ..... *C10M 133/44* (2013.01); *C10M 129/10* (2013.01); *C10M 129/50* (2013.01); *C10M 135/10* (2013.01); *C10M 137/10* (2013.01); *C10M 159/22* (2013.01); *C10M 2205/022* (2013.01); *C10M 2205/024* (2013.01); *C10M 2205/04* (2013.01); *C10M 2207/027* (2013.01); *C10M 2207/028* (2013.01); *C10M 2207/262* (2013.01); *C10M 2215/28* (2013.01); *C10M 2215/30* (2013.01); *C10M 2219/022* (2013.01); *C10M 2219/046* (2013.01); *C10M 2219/088* (2013.01); *C10M 2219/089* (2013.01); *C10M 2223/045* (2013.01); *C10N 2010/02* (2013.01); *C10N 2010/04* (2013.01); *C10N 2030/02* (2013.01); *C10N 2030/04* (2013.01); *C10N 2030/06* (2013.01); *C10N 2030/08* (2013.01); *C10N 2030/10* (2013.01); *C10N 2030/12* (2013.01); *C10N 2030/40* (2020.05); *C10N 2030/52* (2020.05); *C10N 2040/25* (2013.01); *C10N 2040/252* (2020.05)

(58) Field of Classification Search

CPC ..... C10M 129/10; C10M 129/50; C10M 133/44; C10M 135/10; C10M 137/10; C10M 159/22; C10M 2205/022; C10M 2205/024; C10M 2205/04; C10M 2205/06; C10M 2207/027; C10M 2207/028; C10M 2207/262; C10M 2215/28; C10M 2215/30; C10M 2219/022; C10M 2219/046; C10M 2219/088; C10M 2219/089; C10M 2223/045; C10N 2010/02; C10N 2010/04; C10N 2030/02; C10N 2030/04; C10N 2030/06; C10N 2030/08; C10N 2030/10; C10N 2030/12; C10N 2030/40; C10N 2030/52; C10N 2040/25; C10N 2040/252

See application file for complete search history.

(56) References Cited

U.S. PATENT DOCUMENTS

| | | | | |
|---|---|---|---|---|
| 2,409,687 | A | 10/1946 | Rogers | |
| 2,680,096 | A | 6/1954 | Walker et al. | |
| 3,372,116 | A | 3/1968 | Meinhardt et al. | |
| 3,718,589 | A * | 2/1973 | Rogers | C10M 159/22 508/417 |
| 4,328,111 | A | 5/1982 | Watson et al. | |
| 6,015,778 | A | 1/2000 | Rolfes | |
| 7,435,709 | B2 | 10/2008 | Stonebraker et al. | |
| 2008/0269351 | A1 | 10/2008 | Campbell et al. | |
| 2009/0275491 | A1 * | 11/2009 | Komatsubara | C10M 163/00 508/192 |

(Continued)

FOREIGN PATENT DOCUMENTS

| | | |
|---|---|---|
| WO | 2005026299 A1 | 3/2005 |
| WO | 2013059173 A1 | 4/2013 |

*Primary Examiner* — James C Goloboy

(74) *Attorney, Agent, or Firm* — Christopher P. Demas; Teresan W. Gilbert

(57) ABSTRACT

The disclosed technology provides alkylphenol-containing detergent having at least one unit (a) of an alkyl-substituted phenol wherein the alkyl group is derived from oligomers of an olefin compound containing 3 to 8 carbon atoms, wherein the polyolefin-derived alkyl group comprises at least 30 mol percent of an olefin with 4 or more carbon atoms. The invention further relates to a method of lubricating a mechanical device with the lubricant composition.

11 Claims, No Drawings

(56) References Cited

U.S. PATENT DOCUMENTS

| | | | | |
|---|---|---|---|---|
| 2010/0029527 | A1 | 2/2010 | Campbell et al. | |
| 2011/0118160 | A1 | 5/2011 | Campbell et al. | |
| 2011/0124539 | A1 | 5/2011 | Sinquin et al. | |
| 2011/0190185 | A1 | 8/2011 | Sinquin et al. | |
| 2012/0111300 | A1 | 5/2012 | Crawley | |
| 2012/0247412 | A1* | 10/2012 | Toman | C10M 133/08 123/1 A |

* cited by examiner

ALKYLPHENOL DETERGENTS

This is a continuation of co-pending U.S. application Ser. No. 16/211,890 filed on Dec. 6, 2018, which was a continuation of U.S. application Ser. No. 15/313,128 filed on Nov. 22, 2016, which claims priority from PCT Application Serial No. PCT/US2015/031939 filed on May 21, 2015, which claims the benefit of U.S. Provisional Application No. 62/003,608 filed on May 28, 2014, the entirety of all of which is hereby incorporated by reference.

BACKGROUND OF THE INVENTION

The disclosed technology relates to hydrocarbyl- (e.g. alkyl-) phenol detergents and their salts. Such compounds and their salts are useful as lubricant additives.

Phenol-based detergents are known. Among these are phenates based on phenolic monomers, linked with sulfur bridges or alkylene bridges such as methylene linkages derived from formaldehyde. The phenolic monomers themselves are typically substituted with an aliphatic hydrocarbyl group to provide a measure of oil solubility. The hydrocarbyl groups may be alkyl groups, and, historically, dodecylphenol (or propylene tetramer-substituted phenol) has been widely used. An early reference to basic sulfurized polyvalent metal phenates is U.S. Pat. No. 2,680,096, Walker et al., Jun. 1, 1954; see also U.S. Pat. No. 3,372,116, Meinhardt, Mar. 6, 1968.

Recently, however, certain alkylphenols and products prepared from them have come under increased scrutiny due to their association as potential endocrine disruptive materials. In particular, alkylphenol detergents which are based on phenols alkylated with oligomers of propylene, specifically propylene teramer (or tetrapropenyl), may contain residual alkyl phenol species. There is interest, therefore, in developing alkyl-substituted phenol detergents, for uses in lubricants, fuels, and as industrial additives, which contain a reduced or eliminated amount of dodecylphenol component and other substituted phenols having propylene oligomer substituents of 10 to 15 carbon atoms. Nevertheless, it is desirable that the products should have similar oil-solubility parameters as phenates prepared from C10-15 propylene oligomers.

There have been several efforts to prepare phenate detergents that do not contain Cn alkyl phenols derived from oligomers of propylene. U.S. Pat. No. 7,435,709, Stonebraker et al., Oct. 14, 2008, discloses a linear alkylphenol derived detergent substantially free of endocrine disruptive chemicals. It comprises a salt of a reaction product of (1) an olefin having at least 10 carbon atoms, where greater than 90 mole % of the olefin is a linear C20-C30 n-alpha olefin, and wherein less than 10 mole % of the olefin is a linear olefin of less than 20 carbon atoms, and less than 5 mole % of the olefin a branched chain olefin of 18 carbons or less, and (2) a hydroxyaromatic compound.

U.S. Application 2011/0190185, Sinquin et al, Aug. 4, 2011, discloses an overbased salt of an oligomerized alkylhydroxyaromatic compound. The alkyl group is derived from an olefin mixture comprising propylene oligomers having an initial boiling point of at least about 195° C. and a final boiling point of greater than 325° C. The propylene oligomers may contain a distribution of carbon atoms that comprise at least about 50 weight percent of C14 to C20 carbon atoms.

U.S. Application 2011/0124539, Sinquin et al, May 26, 2011, discloses an overbased, sulfurized salt of an alkylated hydroxyaromatic compound. The alkyl substituent is a residue of at least one isomerized olefin having from 15 to about 99 wt. % branching. The hydroxyaromatic compound may be phenol, cresols, xylenols, or mixtures thereof.

U.S. Application 2011/0118160, Campbell et al., May 19, 2011, discloses an alkylated hydroxyaromatic compound substantially free of endocrine disruptive chemicals. An alkylated hydroxyaromatic compound is prepared by reacting a hydroxyaromatic compound with at least one branched olefinic propylene oligomer having from about 20 to about 80 carbon atoms. Suitable hydroxyaromatic compounds include phenol, catechol, resorcinol, hydroquinone, pyrogallol, cresol, and the like.

U.S. Application 2010/0029527, Campbell et al., Feb. 4, 2010, discloses an overbased salt of an oligomerized alkylhydroxyaromatic compound. The alkyl group is derived from an olefin mixture comprising propylene oligomers having an initial boiling point of at least about 195° C. and a final boiling point of no more than about 325° C. Suitable hydroxyaromatic compounds include phenol, catechol, resorcinol, hydroquinone, pyrogallol, cresol, and the like.

U.S. Application 2008/0269351, Campbell et al., Oct. 30, 2008, discloses an alkylated hydroxyaromatic compound substantially free of endocrine disruptive chemicals, prepared by reacting a hydroxyaromatic compound with a branched olefinic oligomer having from about 20 to about 80 carbon atoms.

WO/PCT application 2013/059173, Cook et al., discloses discloses an overbased salt of an oligomerized alkylhydroxyaromatic compound. The alkyl group is a combination of very short hydrocarbyl group (i.e. 1 to 8 carbon atoms) and a long hydrocarbyl group (at least about 25 carbon atoms). Suitable compounds include those made from a mixture of para-cresol and polyisobutylene-substituted phenol.

Other general technology includes that of U.S. Pat. No. 6,310,009, Carrick et al., Oct. 30, 2001, which discloses salts of the general structure

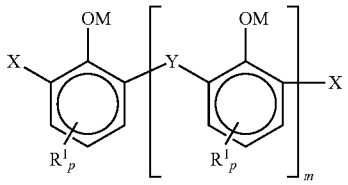

where R may be an alkyl group of 1 to 60 carbon atoms, e.g., 9 to 18 carbon atoms. It is understood that $R^1$ will normally comprise a mixture of various chain lengths, so that the foregoing numbers will normally represent an average number of carbon atoms in the $R^1$ groups (number average).

SUMMARY OF THE INVENTION

The disclosed technology, may solve at least one problem of providing a phenolic material with appropriate oil solubility, providing anti-wear performance, providing oxidation performance, viscosity performance, and detergency (characteristic of moderate chain length alkyl groups). In one embodiment the disclosed technology may also solve the problem of containing C12 alkyl phenol moieties i.e., the disclosed technology may be free from or substantially free from C12 alkyl phenol moieties typically formed from oligomerisation or polymerisation of propylene.

The disclosed technology provides an alkylphenol-containing detergent compound comprising an alkyl-substituted phenol wherein the alkyl group is derived from oligomers of an olefin compound containing 3 to 8 carbon atoms, and wherein the polyolefin-derived alkyl group comprises at least 30 mol percent of an olefin with 4 or more carbon atoms. The alkylphenol compound may be derived from oligomers of n-butene, where the alkyl group is a hydrocarbyl group of 12 to 48 carbon atoms. In certain embodiments, the alkylphenol detergent is substantially free of (or entirely free of, or contains less than 5 percent or 3 percent or 1 percent or 0.3 percent or 0.1 percent by mole of) oligomer units containing propylene. In certain embodiments, the alkylphenol detergent is substantially free from or substantially free from C12 alkyl phenol moieties.

The alkylphenol-containing detergent may be a sulfur-bridged phenate detergent, a sulfur-free alkylene-bridged phenate detergent, a salicylate detergent, or mixtures thereof. Detergents of this type are ionic detergents, i.e. they generally comprise a salt of the detergent substrate (the phenol-containing material) and a suitable cationic counterion. Detergents of the disclosed technology may be metal-containing salts, amine or ammonium containing salts, or mixtures thereof. In one embodiment, the detergent comprises one or more alkali metals, one or more alkaline earth metals, or mixtures thereof.

In another expression, the disclosed technology provides a bridged dimeric or oligomeric phenolic compound comprising an oligomeric material comprising: at least one monomer unit of an alkyl-substituted phenol wherein the alkyl group may be derived from oligomers of an olefin compound containing 3 to 8 carbon atoms, or mixtures thereof; and at least one sulfur-containing or carbon-containing bridging group; or a salt of said oligomeric material; wherein the alkyl group may be a hydrocarbyl group of 12 to 50 carbon (16 to 40, or 16 to 36 or 18 to 28 or 18 to 36).

The disclosed technology may include a process to prepare an alkylphenol-containing detergent compound comprising (i) forming an alkyl-substituted phenol wherein the alkyl group is derived from oligomers of an olefin compound containing 3 to 8 carbon atoms, and wherein the polyolefin-derived alkyl group comprises at least 30 mol percent of an olefin with 4 or more carbon atoms to form a substrate, and then reacting the substrate with a metal base (such as an alkali metal or alkaline earth metal oxide or hydroxide), in the presence of carbon dioxide to form an alkylphenol-containing detergent. The reaction conditions for the process are known in the art and include alkylation of phenol in the presence of known catalysts including $BF_3$, $AlCl_3$, or HF. The reaction of the substrate with a metal base), in the presence of carbon dioxide are well known processes in the art of preparing detergents.

The disclosed technology also provides a lubricant comprising an oil of lubricating viscosity and said alkylphenol detergent, as well as a method of lubricating a mechanical device with said lubricant.

The disclosed technology also provides a method of lubricating a mechanical device comprising supplying to the mechanical device a lubricating composition disclosed herein.

The disclosed technology also provides for the use of the alkylphenol detergent in a lubricating composition to provide detergency, deposit control and oxidative stability to the lubricant.

DETAILED DESCRIPTION OF THE INVENTION

The disclosed technology provides an alkylphenol detergent, a lubricating composition, a method for lubricating an internal combustion engine and a use as disclosed herein.

One of the materials of the presently disclosed technology may be a bridged alkylphenol compound. Such materials in general, their methods of preparation, and use in lubricants are well known from, for instance, the above-referenced U.S. Pat. No. 2,680,096, Walker et al. They may be prepared starting from alkyl phenol such as alkylphenols derived from oligomers of n-butene, or mixtures thereof, any of which are readily available as starting materials. The alkylation of phenol and its homologues is well known, typically by catalyzed reaction of an olefin, often an □-olefin, with phenol (or with salicylic acid or another homologue, as the case may be). Alkylation of phenol is described in greater detail in the Kirk-Othmer Encyclopedia of Chemical Technology, third edition (1978) vol. 2, pages 82-86, John Wiley and Sons, New York.

Linking of alkyl (or more generally, hydrocarbyl) phenols to form oligomeric species, is also well known. They may be condensed, for instance, with formaldehyde or with other aldehydes or ketones such as acetone to form methylene (or alkylene) bridged structures, as described on pages 76-77 of the above cited Kirk-Othmer reference. If condensation with an aldehyde or ketone is intended, it is desirable that the aldehyde or ketone not be a C12 species, to avoid the formation of any C12 substituted phenolic materials. In certain embodiments the material may be an aldehyde of 8 or fewer carbon atoms, such as 1 to 4, or 1 or 2, or a single carbon atom (formaldehyde). The length of the resulting oligomeric chain of phenolic and alkylene units will depend to some extent on the molar ratio of the reactants, as is well known. Thus an equimolar amount of phenol and formaldehyde provides a condensate with a relatively longer oligomeric chain than that obtained when there is a stoichiometric excess of one species or the other. Under certain conditions, carbon- and oxygen-containing linkages may also be formed, such as those of the general structure $—CH_2—O—CH_2—$ or homologues in which the hydrogens are replaced by alkyl groups. These may be formed by the condensation of more than a single aldehyde or ketone group. Such structures are known, for exam-pie, from U.S. Pat. No. 6,310,009, see col. 2 lines 14-17 and col. 6 lines 1-45. Thus the linking groups prepared form aldehydes or ketones may be generally described as "carbon-containing" bridging groups, e.g., an alkylene bridge or an ether bridge.

Substituted phenols may also be linked together to make sulfur bridged species, which may include bridges of single sulfur atoms (—S—) or multiple sulfur atoms (e.g., $—S_x—$ where x may be 2 to 8, typically 2 or 3). Sulfurized phenols may be prepared by reaction with active sulfur species such as sulfur monochloride or sulfur dichloride as described on pages 79-80 of the Kirk-Othmer reference or with elemental sulfur, as described, for instance, in U.S. Pat. No. 2,680,096. Sulfurization (with sulfur) may be conducted in the presence of a basic metal compound such as calcium hydroxide or calcium oxide, thus preparing a metal salt, as described in greater detail, below. Basic sulfurized phenates and a method for their preparation are also disclosed in U.S. Pat. No. 3,410,798, Cohen, Nov. 12, 1968. The examples and claim 1 thereof disclose a method, comprising reacting at a temperature above about 150° C., (A) a phenol, (B) sulfur, and (C) an alkaline earth base, in the presence of a promoter comprising (D) about 5-20 mole percent, based on the amount of component A, of a carboxylic acid or alkali metal, alkaline earth metal, zinc, or lead salt thereof and (E) as a solvent, a compound of the formula $R(OR')_xOH$, e.g., a polyalkylene glycol. The phenol (A), in turn, may be a hydrocarbyl-substituted phenol which may be prepared by mixing a hydrocarbon and a phenol at a temperature of about 50-200° C. in the presence of a suitable catalyst such as aluminum trichloride (col. 2 line 51 of U.S. Pat. No. 3,410,798, and following text).

Alkylphenol

In the present technology, the alkyl group is derived from a polyolefin compound comprising n-butene (also referred to as 1-butene) monomers, higher alpha-olefins, or mixtures thereof. In addition to n-butene, suitable alpha-olefins include isobutylene, 1-pentene, 1-hexene, 1-heptene, 1-octene, 1-nonene, 1-decene, and mixtures thereof. In one embodiment, the alkyl group of the alkylphenol is a polyolefin compound comprising at least 25 mol % 1-butene, at least 50 mol % 1-butene, or at least 75 mol % 1-butene. In one embodiment, the alkyl group of the alkylphenol consists of oligomers or polymers of 1-butene.

Suitable polyolefins include oligomers or polymers of n-butene. A butene polymer or oligomer containing 8 to 48 carbon atoms would contain 2 to 12 butene monomer units. An n-butene polymer or oligomer containing 12 to 32 carbon atoms would contain 3 or 8 n-butene monomer units. Further details of alkylation are disclosed in the above-cited Kirk Othmer reference.

The alkylphenol from which the detergent may be derived may be characterized as a phenol substituted with one or more alkyl groups derived from a polyolefin or oligomerized olefin as described above. The alkylphenol may contain one or more alkyl groups derived from an oligomer (or polymer) of n-butene. In one embodiment, the alkylphenol may be $C_8$ to $C_{48}$ alkylphenol, a $C_{12}$ to $C_{32}$ alkylphenol, a $C_{16}$ to $C_{24}$ alkylphenol, or mixtures thereof, wherein the alkyl groups are oligomers of n-butene.

Bridged Phenol Detergents

In certain embodiments, the alkylphenol-containing detergent may be a sulfur-bridged phenate detergent, a sulfur-free alkylene-bridged phenate detergent, or mixtures thereof. Detergents of this type are ionic (usually metal) salts of bridged phenolic compounds. The bridged phenolic compound material may be represented by the structure (I)

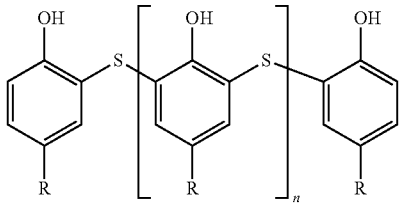

or more generally (II)

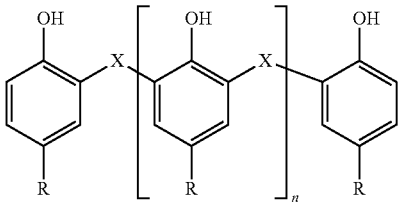

or isomers thereof, wherein each R may be an aliphatic hydrocarbyl group derived from oligomers of n-butene, higher alphaolefins, or mixtures thereof, and wherein the hydrocarbyl group contains 8 to 48 carbon atoms. The average number of carbon atoms in all the R groups, combined, may be 16 to 100 (or 20 to 50, or 24 to 36 or 14 to 20 or 18 to 36). Where the bridging group may be listed as "X", each X may independently a carbon-containing bridge, or an alkylene group, or a methylene group, or a bridge of 1 or more sulfur atoms represented by $S_y$, where y may be 1 to 4, especially 1 or 2. In these structures, n may, in certain embodiments, be 0 to 8, or 1 to 6, or 1 to 4, or 2 to 4. That is, the bridged material may, in these embodiments, contain 2 to 10 bridged phenolic groups, or 3 to 7, or 3 to 5, or 4 such groups. Since n may be zero, it may be evident that throughout this specification, the expression "oligomeric" may be interpreted to include dimeric species. Accordingly, sometimes the expression "dimeric or oligomeric" may be used to express this concept, which may include, as above, as an example, 0 to 8 interior units bracketed by $[\ ]_n$ or 2 to 10 units overall. In certain embodiments, in the above structure, one or two of the R groups are aliphatic hydrocarbyl groups containing 30 to 200 or 35 to 80 carbon atoms and the remainder of the R groups are methyl groups.

In one embodiment, the sulfur-bridged alkylphenol-containing detergent may be an oligomer of p-(tetrabutenyl) phenol. A sulfur-bridged oligomer of oligobutenylphenol may be represented by the structure (III)

(III)

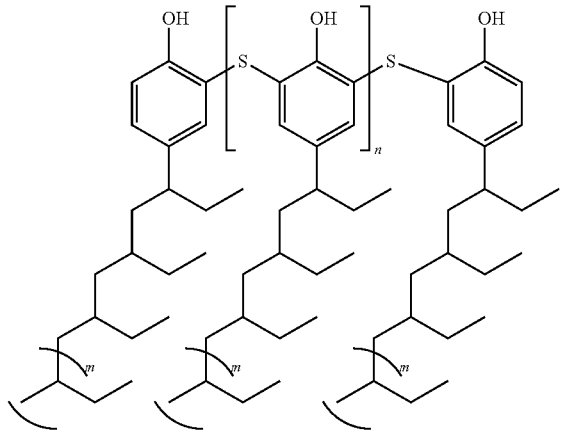

where n=0 to 4, and m=1 to 3.

In certain embodiments, the alkylene-bridged phenate detergent may be a saligenin detergent. A saligenin detergent contains a bridged-alkyl phenol compound that may be an alkylene coupled alkylphenol represented by the structure (IV)

(IV)

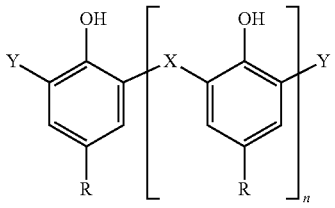

where each R may be an aliphatic hydrocarbyl group derived from oligomers of n-butene, higher alphaolefins, or mixtures thereof, and wherein the hydrocarbyl group contains 8 to 48 carbon atoms; where the each bridging group (X) may be independently a carbon-containing bridge, or a hydrocarbylether linkage (such as —$CH_2$—O—$CH_2$—), or an alkylene group, or a methylene group; each Y may be independently —CHO or —$CH_2OH$; wherein the —CHO groups comprise at least about 10 mole percent of the X and Y groups; and n may be an integer from 1 to 10.

In certain embodiments, the alkylene-bridged phenate detergent may be a salixarate detergent. A salixarate detergent contains a bridged-alkyl phenol compound that may be an alkylene coupled alkylphenol that may be further bridged or coupled to salicylic acid. The bridged phenol of a salixarate may be represented by the structure (V)

(V)

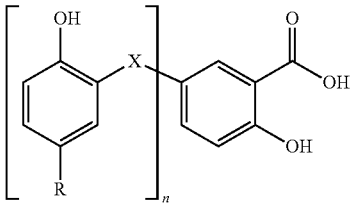

where R may be an aliphatic hydrocarbyl group derived from oligomers of n-butene, higher alphaolefins, or mixtures thereof, and wherein the hydrocarbyl group contains 8 to 48 carbon atoms; where the each bridging group (X) may be independently a carbon-containing bridge, or an alkylene group, or a methylene group; and n may be an integer from 1 to 10

The bridged alkylphenol detergents may be neutral or overbased or superbased. Such overbased detergents are generally single phase, homogeneous Newtonian systems characterized by a metal and/or ammonium content in excess of that which would be present for neutralization according to the stoichiometry of the metal or ammonium and the particular acidic organic compound reacted with the metal or ammonium compound. The overbased materials are typically prepared by reacting an acidic material (typically an inorganic acid or lower carboxylic acid such as carbon dioxide) with a mixture of bridged alkylphenol compounds (referred to as a substrate), a stoichiometric excess of a metal base, typically in a reaction medium of an one inert, organic solvent (e.g., mineral oil, naphtha, toluene, xylene) for the acidic organic substrate. Typically also a small amount of promoter such as a phenol or alcohol is present, and in some cases a small amount of water. The acidic organic substrate will normally have a sufficient number of carbon atoms to provide a degree of solubility in oil.

In certain embodiments, the overbased bridged-phenol detergent may be a metal-containing detergent, an amine or ammonium containing detergent, or mixtures thereof. In one embodiment the overbased metal-containing detergent may be zinc, sodium, calcium or magnesium salts of a phenate, sulfur containing phenate, salixarate or saligenin. In one embodiment, the overbased detergent comprises a salt of an alkylamine or quaternary ammonium compound. Overbased salixarates, phenates and saligenins typically have a total base number (TBN) (by ASTM D3896) of 120 to 600 mg KOH/g.

Salicylates

In certain embodiments, the alkylphenol-containing detergent may be an alkylsalicylate or salicylate detergent. A salicylate detergent may be a neutral or overbased metal salt of alkylsalicylic acid. Alkylsalicylic acid may be represented by the formula (VI)

(VI)

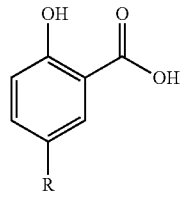

where R may be an aliphatic hydrocarbyl group derived from oligomers of n-butene, higher alphaolefins, or mixtures thereof, and wherein the hydrocarbyl group contains 8 to 48 carbon atoms.

The alkylsalicylate may be a neutral or nearly neutral salt of alkylsalicylic acid; by nearly neutral, it is meant that there is an excess of base of no more than 15 mol percent, i.e. if the salt is metal-containing, the metal ratio is 1.15 or less. In one embodiment the neutral salt of the alkylsalicylic acid may be an amine or ammonium salt, a metal salt, or mixtures thereof.

Amines suitable for use in the preparation of the neutral amine salted alkylsalicylate are not overly limited and may include any alkyl amine, though generally are fatty acid amines derived from fatty carboxylic acids. The alkyl group present in the amine may contain from 10 to 30 carbon atoms, or from 12 to 18 carbon atoms, and may be linear or branched. In some embodiments the alkyl group may be linear and unsaturated. Typical amines include pentadecylamine, octadecylamine, cetylamine, oleylamine, decylamine, dodecylamine, dimethyldodecylamine, tridecylamine, heptadecylamine, octadecylamine, stearylamine, and any combination thereof. In some embodiments the fatty acid derived amine salt of an alkylsalicylic acid may be a salt of oleylamine. In certain embodiments, the amine may be a gamma-aminoester compound; aminoesters of this type may be derived from Michael addition of a primary amine to an alkyl diester of itaconic acid represented by the formula

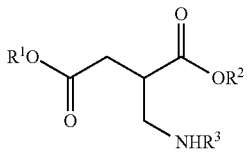

where $R^1$ and $R^2$ are hydrocarbyl groups containing 2 to 30 carbon atoms, and $R^3$ is a hydrocarbyl group containing 4 to 50 carbon atoms. In some embodiments, $R^3$ of the aminoester compound is an alkyl group that has at least one hydrocarbyl group substituted at the 1-, or 2-position of the alkyl group. In one embodiment, the aminoester is dibutyl 2-(((2-ethylhexyl)-amino)methyl)succinate.

In certain embodiments, the neutral salt of the alkylsalicylic acid may be a quaternary ammonium salt, also referred to as a quaternary nitrogen compound. Quaternary nitrogen compounds are characterized in that the nitrogen atom is four-coordinate; this results in a cationic species that is not protic, i.e. an acidic proton is not released under basic conditions. Quaternary nitrogen compounds may be characterized as falling into two large groups, four coordinate tetrahydrocarbylammonium compounds, for example tetrabutylammonium, and three coordinate aromatic compounds, for example N-hydrocarbylpyridinium.

In some embodiments the quaternary nitrogen salt may comprise the reaction product of (a) hydrocarbyl-substituted compound having a tertiary amino group and (b) a quaternizing agent suitable for converting the tertiary amino group of (a) to a quaternary nitrogen, wherein the quaternizing agent may be chosen from dialkyl sulfates, benzyl halides, hydrocarbyl substituted carbonates; hydrocarbyl epoxides in combination with an acid or mixtures thereof. In one embodiment, the quaternary nitrogen salt comprises the reaction product of (i) at least one compound chosen from: a polyalkene-substituted amine having at least one tertiary amino group and/or a Mannich reaction product having a tertiary amino group; and (ii) a quaternizing agent.

The alkylphenol-containing detergents, be they phenates, saligenins, salixrates, or salicylates, may be metal-containing detergents. Metal-containing detergents may be neutral, or very nearly neutral, or overbased. An overbased detergent contains a stoichiometric excess of a metal base for the acidic organic substrate. This is also referred to as metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Third Edition, Edited by R. M. Mortier and S. T. Orszulik, Copyright 2010, page 219, sub-heading 7.25.

In one embodiment the overbased metal-containing alkylphenol detergent may be calcium or magnesium overbased detergent. In one embodiment, the overbased detergent may comprise a calcium alkylphenol detergent with a metal ratio of at least 1.5, at least 3, at least 5, or at least 7. In certain embodiments, the overbased calcium alkylphenol detergent may have a metal ratio of 1.5 to 25, 2.5 to 20 or 5 to 16.

Alternatively, the alkylphenol detergent may be described as having TBN. Overbased phenates and salicylates typically have a total base number of 120 to 600 mg KOH/g, or 150 to 550 mg KOH/g, or 180 to 350 mg KOH/g. The amount of the alkylphenol-containing detergent present in a lubricant composition may be defined as the amount necessary to deliver an amount, or range of amounts, of TBN to the lubricant composition. In certain embodiments, the alkylphenol-containing detergent may be present in a lubricant composition in amount to deliver 0.5 to 10 TBN to the composition, or 1 to 7 TBN, or 1.5 to 5 TBN to the composition.

Overbased detergents may also be defined as the ratio of the neutral detergent salt, also referred to as detergent soap, and the detergent ash. The overbased detergent may have a weight ratio of ash to soap of 3:1 to 1:8, or 1.5:1 to 1 to 4.1, or 1.3:1 to 1:3.4.

The product of the disclosed technology may beneficially be used as an additive in a lubricant. The amount of the alkylphenol detergent in a lubricant may be 0.1 to 8 percent by weight, on an oil-free basis, but including the calcium carbonate and other salts present in an overbased composition. When present as an overbased detergent, the amount may typically be in the range of 0.1 to 25 weight percent, or 0.2 to 28, or 0.3 to 20, or 0.5 to 15 percent. The higher amounts are typical of marine diesel cylinder lubricants, e.g., 1 or 3 or 5 percent up to 25, 20, or 15 percent. Amounts used in gasoline or heavy-duty diesel engines (not marine) will typically be in lower ranges, such as 0.1 to 10 percent or 0.5 to 5 or 1 to 3 percent by weight. When used as a substantially neutral or non-overbased salt, its amount may typically be correspondingly less for each of the engine types, e.g., 0.1 to 10 percent or 0.2 to 8 or 0.3 to 6 percent.

In certain embodiments, the amount of the alkylphenol detergent in a lubricant may be measured as the amount of alkylphenol-containing soap that is provided to the lubricant composition, irrespective of any overbasing. In one embodiment, the lubricant composition may contain 0.05 weight percent to 1.5 weight percent alkylphenol-containing soap, or 0.1 weight percent to 0.9 weight percent alkylphenol-containing soap. In one embodiment, the alkylphenol-containing soap provides 20 percent by weight to 100 percent by weight of the total detergent soap in the lubricating composition. In one embodiment the alkylphenol-containing soap provides 30 percent by weight to 80 percent by weight of the total detergent soap, or 40 percent by weight to 75 percent by weight of the total detergent soap of the lubricating composition.

A lubricant composition may contain alkylphenol-containing detergents different from that of the disclosed technology. In one embodiment, the lubricant composition of the disclosed technology comprises the alkylphenol detergent of the disclosed technology in an amount 0.1 to 25 weight percent, or 0.2 to 28, or 0.3 to 20, or 0.5 to 15 weight percent, and is free of or substantially free of an alkylphenol-containing detergent derived from alkylphenol which is derived from oligomers of propylene, especially tetrapropenyl. "Substantially free of" in this case means no more than 0.01 weight percent or an amount considered to arise through contamination or other unintentional means.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516 (see column 11, line 64 to column 12, line 10).

In one embodiment the oil of lubricating viscosity may be an API Group I to III mineral oil, a Group IV synthetic oil, or a Group V naphthenic or ester synthetic oil, or mixtures thereof. In one embodiment the oil of lubricating viscosity may be an API Group II, Group III mineral oil, or a Group IV synthetic oil, or mixtures thereof.

The amount of the oil of lubricating viscosity present is typically the balance remaining after subtracting from 100 weight % the sum of the amount of the additives of the disclosed technology and the other performance additives.

The lubricating composition may be in the form of a concentrate and/or a fully formulated lubricant. If the lubricating composition of the disclosed technology (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight. Typically the lubricating composition of the disclosed technology comprises at least 50 weight %, or at least 60 weight %, or at least 70 weight %, or at least 80 weight % of an oil of lubricating viscosity.

Other Performance Additives

A lubricating composition may be prepared by adding the product of the process described herein to an oil of lubricating viscosity, optionally in the presence of other performance additives (as described herein below).

The lubricating composition of the disclosed technology optionally comprises other performance additives. The other performance additives include at least one of metal deactivators, viscosity modifiers (other than the soot dispersing additive of the present invention), detergents, friction modifiers, antiwear agents, corrosion inhibitors, dispersants (other than those of the present invention), extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the invention provides a lubricating composition further comprising an overbased metal-containing detergent in addition to the alkylphenol-containing detergent of the present invention. The metal of the metal-containing detergent may be zinc, sodium, calcium, barium, or magnesium. Typically the metal of the metal-containing detergent may be sodium, calcium, or magnesium.

The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a "hybrid" sulfonate/phenate detergent is employed, the "hybrid" detergent would be considered equivalent to amounts of distinct phenate and sulfonate detergents introducing like amounts of phenate and sulfonate soaps, respectively.

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN.

Typically, the overbased metal-containing detergent may be a calcium or magnesium an overbased detergent.

In another embodiment the lubricating composition further comprises a calcium sulfonate overbased detergent having a TBN of 120 to 700. The overbased sulfonate detergent may have a metal ratio of 12 to less than 20, or 12 to 18, or 20 to 30, or 22 to 25.

Overbased sulfonates typically have a total base number of 120 to 700, or 250 to 600, or 300 to 500 (on an oil free basis). Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulfonate detergent may be particularly useful for assisting in improving fuel economy. In one embodiment the sulfonate detergent may be a metal salt of one or more oil-soluble alkyl toluene sulfonate compounds as disclosed in paragraphs [0046] to [0053] of US Patent Application 2008/0119378.

In one embodiment the lubricating composition further comprises 0.01 wt % to 2 wt %, or 0.1 to 1 wt % of a detergent different from the alkylphenol detergent of the disclosed technology, wherein the further detergent is chosen from sulfonates, non-sulfur containing phenates, sulfur containing phenates, sulfonates, salixarates, salicylates, and mixtures thereof, or borated equivalents thereof.

In one embodiment the lubricating composition further comprises a "hybrid" detergent formed with mixed surfactant systems including phenate and/or sulfonate components, e.g. phenate/salicylates, sulfonate/phenates, sulfonate/salicylates, or sulfonates/phenates/salicylates.

The lubricating composition in a further embodiment comprises an antioxidant, wherein the antioxidant comprises a phenolic or an aminic antioxidant or mixtures thereof. The antioxidants include diarylamines, alkylated diarylamines, hindered phenols, or mixtures thereof. When present the antioxidant is present at 0.1 wt % to 3 wt %, or 0.5 wt % to 2.75 wt %, or 1 wt % to 2.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In another embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butyl¬phenol or 4-butyl-2,6-di-tert-butylphenol, or 4-dodecyl-2,6-di-tert-butyhphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

The lubricating composition may in a further embodiment include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetra¬ethylene¬pentamine, pentaethylene-hexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and a polyamine as described above.

The dispersant may be an N-substituted long chain alkenyl succinimide. An example of an N substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

When present, the dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the lubricating composition disclosed herein further comprises an ashless dispersant comprising a succinimide dispersant different from the soot-dispersing additive of the disclosed technology, wherein the succinimide dispersant has a TBN of at least 40 mg KOH/g, and said dispersant is present at 1.2 wt % to 5 wt %, or 1.8 wt % to 4.5 wt % of the lubricating composition.

The succinimide dispersant may comprise a polyisobutylene succinimide, wherein the polyisobutylene from which polyisobutylene succinimide is derived has a number average molecular weight of 350 to 5000, or 750 to 2500.

In one embodiment the friction modifier may be chosen from long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurised fatty compounds and olefins, molybdenum dialkyldithiophosphates, molybdenum dithiocarbamates, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis (S-alkyldithiocarbamyl) disulfides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2 ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In a further embodiment the titanium (IV) carboxylate is titanium neodecanoate.

The lubricating composition may in one embodiment further include a phosphorus-containing antiwear agent.

Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Extreme Pressure (EP) agents that are soluble in the oil include sulfur- and chlorosulfur-containing EP agents, dimercaptothiadiazole or CS2 derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the lubricant compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Other viscosity modifiers may include a block copolymer comprising (i) a vinyl aromatic monomer block and (ii) a conjugated diene olefin monomer block (such as a hydrogenated styrene-butadiene copolymer or a hydrogenated styrene-isoprene copolymer), a polymethacrylate, or mixtures thereof.

Pour point depressants that may be useful in the lubricant compositions of the disclosed technology include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

An engine lubricant composition in different embodiments may have a composition as disclosed in the following table:

| | Embodiments (wt %) | | |
|---|---|---|---|
| Additive | A | B | C |
| Alkylphenol Detergent | 0.05 to 10 | 0.2 to 5 | 0.5 to 2 |
| Corrosion Inhibitor | 0.05 to 2 | 0.1 to 1 | 0.2 to 0.5 |
| Other Overbased Detergent | 0 to 9 | 0.5 to 8 | 1 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | | |

Industrial Application

The technology disclosed may include a method of lubricating an internal combustion engine comprising supplying to the engine a lubricating composition comprising (a) an oil of lubricating viscosity and (b) a phenol-containing detergent comprising at least one unit (a) of an alkyl-substituted phenol wherein the alkyl group is derived from oligomers of an olefin compound containing 3 to 8 carbon atoms, wherein the polyolefin-derived alkyl group comprises at least 30 mol percent of an olefin with 4 or more carbon atoms.

The technology disclosed may include a method of lubricating an internal combustion engine comprising supplying to the engine a lubricating composition comprising (a) an oil of lubricating viscosity, (b) a phenol-containing detergent comprising at least one unit (a) of an alkyl-substituted phenol wherein the alkyl group is derived from oligomers of an olefin compound containing 3 to 8 carbon atoms, wherein the polyolefin-derived alkyl group comprises at least 30 mol percent of an olefin with 4 or more carbon atoms, and (c) a zinc dialkyldithiophosphate.

The technology disclosed may include a method of lubricating an internal combustion engine comprising supplying to the engine a lubricating composition comprising (a) an oil of lubricating viscosity, (b) a phenol-containing detergent comprising at least one unit (a) of an alkyl-substituted phenol wherein the alkyl group is derived from oligomers of an olefin compound containing 3 to 8 carbon atoms, wherein the polyolefin-derived alkyl group comprises at least 30 mol percent of an olefin with 4 or more carbon atoms, (c) a zinc dialkyldithiophosphate, and (d) a polyisobutylene succinimide dispersant.

The internal combustion engine may be a 2-stroke engine, or a 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The internal combustion engine may be a 4-stroke engine. The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

The internal combustion engine may be port fuel injected or direct injection. In one embodiment, the internal combustion engine is a gasoline direct injection (GDI) engine.

The lubricating composition may have a total sulfated ash content of 1.2 wt % or less. The sulfur content of the lubricating composition may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.1 wt % of the lubricating composition. In one embodiment the sulfated ash content may be 0.5 wt % to 1.1 wt % of the lubricating composition.

In one embodiment the lubricating composition may be characterized as having (i) a sulfur content of 0.5 wt % or less, (ii) a phosphorus content of 0.15 wt % or less, and (iii) a sulfated ash content of 0.5 wt % to 1.5 wt % or less.

The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less.

The lubricating composition may be characterized as having a sulfated ash content of 0.5 wt % to 1.2 wt %.

As used herein TBN values are (total base number) measured by the methodology described in D4739 (buffer).

The lubricating composition may be characterized as having a total base number (TBN) content of at least 5 mg KOH/g.

The lubricating composition may be characterized as having a total base number (TBN) content of 6 to 13 mg KOH/g, or 7 to 12 mg KOH/g. The lubricant may have a SAE viscosity grade of XW-Y, wherein X may be 0, 5, 10, or 15; and Y may be 16, 20, 30, or 40.

The internal combustion engine disclosed herein may have a steel surface on a cylinder bore, cylinder block, or piston ring.

The internal combustion engine disclosed herein may be a 2-stroke marine diesel engine, and the disclosed technology may include a method of lubricating a marine diesel cylinder liner of a 2-stroke marine diesel engine.

The internal combustion engine may have a surface of steel, or an aluminum alloy, or an aluminum composite. The internal combustion engine may be an aluminum block engine where the internal surface of the cylinder bores has been thermally coated with iron, such as by a plasma transferred wire arc (PTWA) thermal spraying process. Thermally coated iron surfaces may be subjected to conditioning to provide ultra-fine surfaces.

The internal combustion engine may have a laden mass (sometimes referred to as gross vehicle weight rating (GVWR)) of over 2,700 kg (or 6,000 USA pounds) 2,900 kg, or over 3.00 kg, or over 3,300 kg, or over 3,500 kg, or over 3,700 kg, or over 3,900 kg (or 8,500 USA pounds). Typically the upper limit on the laden mass or GVWR is set by national government and may be 10,000 kg, or 9,000 kg, or 8,000 kg, or 7,500 kg.

Heavy duty diesel engines are noted to be limited to all motor vehicles with a "technically permissible maximum laden mass" over 3,500 kg, equipped with compression ignition engines or positive ignition natural gas (NG) or LPG engines. In contrast, the European Union indicates that for new light duty vehicles (passenger cars and light commercial vehicles) included within the scope of ACEA testing section "C" have a "technically permissible maximum laden mass" not exceeding 2610 kg.

There is a distinct difference between passenger car, and heavy duty diesel engines. The difference in size from over 3,500 kg to not more than 2610 kg means that engines of both types will experience significantly different operating conditions such as load, oil temperatures, duty cycle and engine speeds. Heavy duty diesel engines are designed to maximize torque for hauling payloads at maximum fuel economy while passenger car diesels are designed for commuting people and acceleration at maximum fuel economy. The designed purpose of the engine hauling versus communing results in different hardware designs and resulting stresses imparted to lubricant designed to protect and lubricate the engine. Another distinct design difference is the operating revolution per minute (RPM) that each engine operates at to haul versus commute. A heavy duty diesel engine such as a typical 12-13 litre truck engine would typically not exceed 2200 rpm while a passenger car engine can go up to 4500 rpm. In one embodiment the internal combustion engine is a heavy duty diesel compression ignited internal combustion engine (or a spark assisted compression ignited) internal combustion engine.

Typically the vehicle powered by the compression-ignition internal combustion engine of the disclose technology has a maximum laden mass over 3,500 kg (a heavy duty diesel engine).

The following examples provide illustrations of the disclosed technology. These examples are non-exhaustive and are not intended to limit the scope of the disclosed technology.

EXAMPLES

Detergent examples of the disclosed technology include those prepared by the following experimental procedures.

Example 1

To a 12 L four-necked round-bottom flask, equipped with a thermowell and nitrogen inlet, with subsurface sparge tube, a Dean-Stark trap, Friedrichs condenser, and a scrubber, is charged 2000 g 4-(5-ethyl-7-methylnonan-3-yl)phenol. The 4-(5-ethyl-7-methylnonan-3-yl)phenol is heated to 100° C. and 120 g hydrated lime and 45 g ethylene glycol are added. The temperature is increased to 123° C. and 327 g sulfur is added. The mixture is heated to 175° C. and maintained at that temperature for 6 hours, at which time 2493 g diluent oil is added and the reaction is allowed to cool.

The material in the reactor is heated to 135° C., and 930 g hydrated lime, 550 g ethylene glycol, 170 g alkylbenzenesulfonic acid, and 700 g decyl alcohol are added. The mixture is heated to 168° C. and maintained at that temperature until liquid is no longer readily distilling. Flow of carbon dioxide is begun at 85 L/hr (3 $ft^3$/hr) and continued for 2 hours 45 minutes. Volatile materials are removed by stripping at 213-218° C. at less than 5300 Pa (40 torr) for 45 minutes. During cooling, polyisobutenes-substituted succinic anhydride (300 g) is added. The crude product is filtered through diatomaceous earth. (Actual TBN 239; % S 3.23; % Ca 8.76).

Example 2

To a 12 L four-necked round-bottom flask, equipped with a thermowell and nitrogen inlet, with subsurface sparge tube, a Dean-Stark trap, Friedrichs condenser, and a scrubber, is charged 2000 g 4-(5,7-diethyl-9-methylundecan-3-yl)

phenol. The 4-(5,7-diethyl-9-methylundecan-3-yl)phenol is heated to 100° C. and 120 g hydrated lime and 45 g ethylene glycol are added. The temperature is increased to 123° C. and 327 g sulfur is added. The mixture is heated to 175° C. and maintained at that temperature for 6 hours, at which time 2493 g diluent oil is added and the reaction is allowed to cool.

The material in the reactor is heated to 135° C., and 930 g hydrated lime, 550 g ethylene glycol, 170 g alkylbenzenesulfonic acid, and 700 g decyl alcohol are added. The mixture is heated to 168° C. and maintained at that temperature until liquid is no longer readily distilling. Flow of carbon dioxide is begun at 85 L/hr (3 $ft^3$/hr) and continued for 2 hours 45 minutes. Volatile materials are removed by stripping at 213-218° C. at less than 5300 Pa (40 torr) for 45 minutes. During cooling, polyisobutenes-substituted succinic anhydride (300 g) is added. The crude product is filtered through diatomaceous earth. (Theoretical TBN 245; % S 3.37; % Ca 8.8).

Example 3

To a 12 L four-necked round-bottom flask, equipped with a thermowell and nitrogen inlet, with subsurface sparge tube, a Dean-Stark trap, Friedrichs condenser, and a scrubber, is charged 2429 g 4-(5,7-diethyl-9-methylundecan-3-yl) phenol. The 4-(5,7-diethyl-9-methylundecan-3-yl)phenol is heated to 100° C. and 120 g hydrated lime and 45 g ethylene glycol are added. The temperature is increased to 123° C. and 327 g sulfur is added. The mixture is heated to 175° C. and maintained at that temperature for 6 hours, at which time 2063 g diluent oil is added and the reaction is allowed to cool.

The material in the reactor is heated to 135° C., and 930 g hydrated lime, 550 g ethylene glycol, 170 g alkylbenzenesulfonic acid, and 700 g decyl alcohol are added. The mixture is heated to 168° C. and maintained at that temperature until liquid is no longer readily distilling. Flow of carbon dioxide is begun at 85 L/hr (3 $ft^3$/hr) and continued for 2 hours 45 minutes. Volatile materials are removed by stripping at 213-218° C. at less than 5300 Pa (40 torr) for 45 minutes. During cooling, polyisobutenes-substituted succinic anhydride (300 g) is added. The crude product is filtered through diatomaceous earth. (Theoretical TBN 245; % S 3.37; % Ca 8.8).

Example 4

To a 10 L four-necked round-bottom flask, equipped with a thermowell and nitrogen inlet, with subsurface sparge tube, a Dean-Stark trap, Friedrichs condenser, and a scrubber, is charged 2000 g 4-(5-ethyl-7-methylnonan-3-yl)phenol. The 4-(5-ethyl-7-methylnonan-3-yl)phenol is heated to 100° C. and 177 g hydrated lime and 139 g ethylene glycol are added. The temperature is increased to 123° C. and 362 g sulfur is added. The mixture is heated to 182° C. and maintained at that temperature for 7 hours, at which time 862 g diluent oil is added and the reaction is allowed to cool.

The material in the reactor is heated to 135° C., and 139 g hydrated lime, 109 g ethylene glycol, and 257 g decyl alcohol are added. The mixture is heated to 168° C. and maintained at that temperature until liquid is no longer readily distilling and continued for a further hour. Volatile materials are removed by stripping at 213-218° C. at less than 5300 Pa (40 torr) for 45 minutes. The crude product is filtered through diatomaceous earth. (Theoretical TBN 145; % S 4.7; % Ca 5.3).

Example 5

To a 10 L four-necked round-bottom flask, equipped with a thermowell and nitrogen inlet, with subsurface sparge tube, a Dean-Stark trap, Friedrichs condenser, and a scrubber, is charged 2000 g 4-(5,7-diethyl-9-methylundecan-3-yl) phenol. The 4-(5,7-diethyl-9-methylundecan-3-yl)phenol is heated to 100° C. and 177 g hydrated lime and 139 g ethylene glycol are added. The temperature is increased to 123° C. and 362 g sulfur is added. The mixture is heated to 182° C. and maintained at that temperature for 7 hours, at which time 862 g diluent oil is added and the reaction is allowed to cool.

The material in the reactor is heated to 135° C., and 139 g hydrated lime, 109 g ethylene glycol, and 257 g decyl alcohol are added. The mixture is heated to 168° C. and maintained at that temperature until liquid is no longer readily distilling and continued for a further hour. Volatile materials are removed by stripping at 213-218° C. at less than 5300 Pa (40 torr) for 45 minutes. The crude product is filtered through diatomaceous earth. (Theoretical TBN 145; % S 4.7; % Ca 5.3).

Example 6

To a 10 L four-necked round-bottom flask, equipped with a thermowell and nitrogen inlet, with subsurface sparge tube, a Dean-Stark trap, Friedrichs condenser, and a scrubber, is charged 2429 g 4-(5,7-diethyl-9-methylundecan-3-yl) phenol. The 4-(5,7-diethyl-9-methylundecan-3-yl)phenol is heated to 100° C. and 177 g hydrated lime and 139 g ethylene glycol are added. The temperature is increased to 123° C. and 362 g sulfur is added. The mixture is heated to 182° C. and maintained at that temperature for 7 hours, at which time 433 g diluent oil is added and the reaction is allowed to cool.

The material in the reactor is heated to 135° C., and 139 g hydrated lime, 109 g ethylene glycol, and 257 g decyl alcohol are added. The mixture is heated to 168° C. and maintained at that temperature until liquid is no longer readily distilling and continued for a further hour. Volatile materials are removed by stripping at 213-218° C. at less than 5300 Pa (40 torr) for 45 minutes. The crude product is filtered through diatomaceous earth. (Theoretical TBN 145; % S 4.7; % Ca 5.3).

Detergent examples of the disclosed technology also include sulfur-coupled phenates, methylene-coupled phenates (saligenin), salixrate, and salicylate. Examples of alkylphenol substrates of the disclosed technology are summarized in Table 1 below:

TABLE 1

Alkylphenol Substrates

| | Phenol Type (Structure)[1] | Alkyl Group (R)[2] | Bridge (X) | No. Repeat Units (n)[3] |
|---|---|---|---|---|
| AP1 | S-Phenate (I) | Tetrapropenyl (TP) | Sulfur (S) | 2 |
| AP2 | Salicylate | TP | — | — |
| AP3 | S-Phenate (I) | Tetrabutenyl (TB) | Sulfur (S) | 3 |
| AP4 | Saligenin (IV) | TB | Methylene (—$CH_2$—) | 3 |
| AP5 | Salixarate (V) | TB | Methylene (—$CH_2$—) | 3 |
| AP6 | Salicylate (VI) | TB | — | — |

TABLE 1-continued

| Alkylphenol Substrates | | | | |
|---|---|---|---|---|
| | Phenol Type (Structure)[1] | Alkyl Group (R)[2] | Bridge (X) | No. Repeat Units (n)[3] |
| AP7 | Salicylate (VI) | Pentabutenyl (PB) | — | — |
| AP8 | S-Phenate (I) | PB | Sulfur (S) | 2 |
| AP9 | S-Phenate (I) | Tributenyl (TrB) | Sulfur (S) | 2 |

[1]The number in parentheses ( ) refers to structural formula types in the specification
[2]From the structural formulas (R) refers to the primary hydrocarbyl group found in the para-position to the phenol moiety
[3]From the structural formulas (n) refers to an approximation of the phenolic units in addition to base phenol unit Detergents, both neutral and overbased, may be prepared with the substrates summarized above. Detergents of the disclosed technology are summarized in Table 2 below:

TABLE 2

| Alkylphenol-containing Detergents[1] | | | | |
|---|---|---|---|---|
| | | | Theoretical | |
| | Phenol | Counterion | % Metal | Metal Ratio[2] |
| CEX1 | AP1 | Calcium | 15 | 3.5 |
| CEX2 | AP1 | Calcium | 7.1 | 1.1 |
| CEX3 | AP2 | Calcium | 10 | 2.5 |
| EX4 | AP3 | Calcium | 14 | 3.5 |
| EX5 | AP3 | Calcium | 7 | 1.1 |
| EX6 | AP8 | Calcium | 14 | 3.5 |
| EX7 | AP4 | Magnesium | 3 | 0.8 |
| EX8 | AP7 | Calcium | 9.6 | 2.5 |
| EX9 | AP7 | Calcium | 18 | 6 |
| EX10 | AP8 | Calcium | 9 | 3 |
| EX11 | AP7 | Tetrabutyl ammonium (TBA) | 0 | 1.0 |
| EX12 | AP9 | Calcium | 8.76[3] | 3.7 |

[1]All analyticals are on an oil-free basis
[2]Ratio of equivalents of counterion to equivalents of phenol substrate; metal ratio in excess of 1.2 is deemed overbased
[3]Measured value The Total Base Number (TBN) may be determined using the methodology of ASTM D2896.

A series of engine lubricants in Group III base oil of lubricating viscosity are prepared containing the additives described above as well as conventional additives including polymeric viscosity modifier, ashless succinimide dispersant, overbased detergents different from that of the disclosed technology, antioxidants (combination of phenolic ester, diarylamine, and sulfurized olefin), zinc dialkyldithiophosphate (ZDDP), as well as other performance additives as follows (Table 3):

TABLE 3

| Lubricant Compositions[1] | | | | | | | |
|---|---|---|---|---|---|---|---|
| | OIL1 | OIL2 | OIL3 | OIL4 | OIL5 | OIL6 | OIL7 |
| Base Oil | Balance to 100% | | | | | | |
| CEX1 | 0.4 | | 0.6 | | | | |
| CEX2 | 0.33 | | 0.1 | | | | |
| CEX3 | | 1.0 | | | | | |
| EX4 | | | | 0.4 | 0.6 | | |
| EX5 | | | | 0.33 | 0.1 | | |
| EX8 | | | | | | 1.0 | |
| EX11 | | | | | | | 1.8 |
| Sulfonate[2] | 1.0 | 0.5 | 1.0 | 1.0 | 1.0 | 0.5 | 0.3 |
| ZDDP[3] | 1.1 | 1.1 | 1.1 | 1.1 | 1.1 | 1.1 | 0.5 |
| Antioxidant[4] | 0.44 | 0.44 | 0.44 | 0.44 | 0.44 | 0.44 | |

TABLE 3-continued

| Lubricant Compositions[1] | | | | | | | |
|---|---|---|---|---|---|---|---|
| | OIL1 | OIL2 | OIL3 | OIL4 | OIL5 | OIL6 | OIL7 |
| Dispersant[5] | 3.1 | 3.1 | 3.1 | 3.1 | 3.1 | 3.1 | |
| Viscosity Modifier[6] | 1.0 | 1.0 | 1.0 | 1.0 | 1.0 | 1.0 | |
| Additional additives[7] | 0.34 | 0.34 | 0.34 | 0.34 | 0.34 | 0.34 | |

[1]All treat rates on an oil-free basis
[2]Overbased calcium sulfonate detergents
[3]Secondary ZDDP derived from mixture of C3 and C6 alcohols
[4]Sulfurized olefin
[5]Succinimide dispersant derived from succinated polyisobutylene (Mn 2000)
[6]Ethylene-propylene copolymer with Mn of 90,000
[7]Additional additives include surfactant, corrosion inhibitor, anti-foam agents, friction modifiers, and pourpoint depressants

TABLE 4

| Lubricant Compositions | | |
|---|---|---|
| | OIL8 | OIL9 |
| Base Oil | Balance to 100% | |
| Group III Base Oil | 72 | 72 |
| PAO-4 | 28 | 28 |
| CEX1 | 0.98 | |
| EX12 | | 0.98 |
| Sulfonate Detergent[2] | 0.06 | 0.06 |
| ZDDP[3] | 0.79 | 0.79 |
| Antioxidant[4] | 3.6 | 3.6 |
| Dispersant[5] | 6.2 | 6.2 |
| Viscosity Modifier[6] | 1.1 | 1.1 |
| Additional additives[7] | 0.3 | 0.3 |

[1]All treat rates on an oil-free basis
[2]Overbased calcium sulfonate detergent (700 TBN)
[3]Secondary ZDDP derived from mixture of C3 and C6 alcohols
[4]Mixture of hindered phenol, alkylated diarylamine, and sulfurized olefin
[5]Succinimide dispersant derived from high vinylidene polyisobutylene
[6]Styrene-butadiene block copolymer
[7]Additional additives include surfactant, corrosion inhibitor, anti-foam agents, friction modifiers, and pourpoint depressants The lubricants may be evaluated for cleanliness, i.e. the ability to prevent or reduce deposit formation; sludge handling; soot handling; antioxidancy; and wear reduction.

Anti-wear performance is measured in a programmed temperature high frequency reciprocating rig (HFRR) available from PCS Instruments. HFRR conditions for the evaluations are 200 g load, 75 minute duration, 1000 micrometer stroke, 20 hertz frequency, and temperature profile of 15 minutes at 40° C. followed by an increase in temperature to 160° C. at a rate of 2° C. per minute. Wear scar in micrometers and film formation as percent film thickness are then measured with lower wear scar values and higher film formation values indicating improved wear performance.

Deposit control is measured by the Komatsu Hot Tube (KHT) test, which employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 0 (very heavy varnish) to 10 (no varnish).

In the Panel Coker deposit test, the sample, at 105° C., is splashed for 4 hours on an aluminum panel maintained at 325° C. The aluminum plates are analyzed using image analysis techniques to obtain a universal rating. The rating score is based on "100" being a clean plate and "0" being a plate wholly covered in deposit.

Oxidation control is evaluated utilizing pressure differential scanning calorimtery (PDSC) which determines oxidation induction time (OIT) for lubricating compositions. This is a standard test procedure in the lubricating oil industry, based on CEC L-85 T-99. In this testing the lubricating composition is heated to an elevated temperature, typically about 25° C. below the average decomposition temperature for the sample being tested (in this case 215° C. at 690 kPa), and the time to when the composition begins to decompose is measured. The longer the test time, reported in minutes, the better the oxidative stability of the composition and the additives present within it.

TABLE 5

| Performance Testing | | |
|---|---|---|
| | OIL8 | OIL9 |
| ASTM D6335 (TEOST 33C) | | |
| Rod Deposits (mg) | 18.3 | 18.4 |
| Filter Deposits (mg) | 12.3 | 13.2 |
| Total Deposits (mg) | 30.6 | 31.6 |
| ASTM D7097B (MHT TEOST) | | |
| Net deposits-depositor rod (mg) | 8.8 | 5.9 |
| Filter net deposits (mg) | 0 | 0.7 |
| Total Deposits (mg) | 8.8 | 6.6 |
| CEC L-85-T-99 (PDSC) | | |
| Oxidation induction time (min) | 88.8 | 129 |
| Panel Coker | | |
| Universal Rating (%) | 72 | 75 |

As the data illustrates, replacement of the tetrapropenylphenol-based phenate detergent (OIL8) with the tributenylphenol-based phenate (OIL9) results in equivalent or better performance in deposit control and significant improvement in oxidative stability (OIT).

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A calcium overbased alkylphenol-containing detergent comprising at least one unit (a) of an alkylsalicylate represented by the structure

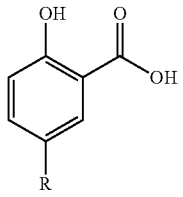

where R is tetra(n-butenyl), and wherein the overbased detergent has a metal ratio of at least 2.5 to 5.

2. A lubricating composition comprising (a) an oil of lubricating viscosity; (b) 1 to 3% by weight of a phenol-containing detergent comprising at least one unit of a calcium overbased alkyl-substituted phenol wherein the alkyl group is tetra(n-butenyl), wherein the detergent is an overbased salt of alkylsalicylic acid, and wherein the overbased detergent has a metal ratio of at least 2.5 to 5; and (c) a zinc dialkyldithiophosphate.

3. A lubricating composition of claim 2, wherein the composition is substantially free of an alkylphenol-containing detergent wherein the alkylphenol is derived from oligomers of propene.

4. The lubricating composition of claim 2, further comprising additional additives selected from an overbased detergent different from alkylphenol-containing detergent of claim 1, an ashless dispersant, a phosphorus-containing anti-wear agent, an antioxidant, a corrosion inhibitor, a viscosity index improver, or combinations thereof.

5. The lubricating composition of claim 4, further comprising 0.01 to 3 weight percent of a calcium overbased alkylbenzene sulfonate detergent.

6. The lubricating composition of claim 4, further comprising 0.01 to 0.15 weight percent of a phosphorus containing anti-wear agent.

7. A method of lubricating an internal combustion engine comprising supplying to the engine a lubricating composition comprising (a) an oil of lubricating viscosity and (b) 1 to 3% by weight phenol-containing detergent comprising at least one unit (a) of a calcium alkylsalicylate represented by the structure

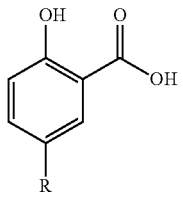

where R is tetra(n-butenyl), and wherein the overbased detergent has a metal ratio of at least 2.5 to 5.

8. The method of claim 7, wherein the lubricating composition further comprises a zinc dialkyldithiophosphate.

9. The method of claim 7, wherein the lubricating composition further comprises polyisobutylene succinimide dispersant.

10. The method of claim 7, wherein the lubricating composition further comprises a zinc dialkyldithiophosphate, and (d) a polyisobutylene succinimide dispersant.

11. The method of claim 7, wherein the internal combustion engine is a heavy duty diesel compression ignited internal combustion engine or a spark assisted compression ignited internal combustion engine.

* * * * *